US008738427B2

(12) United States Patent
Damaghi

(10) Patent No.: US 8,738,427 B2
(45) Date of Patent: May 27, 2014

(54) ENHANCED METHOD OF RADIO AND TV ADVERTISING

(75) Inventor: Babak Damaghi, Great Neck, NY (US)

(73) Assignee: First Quality Enterprises, Inc., Great Neck, NY (US)

( * ) Notice: Subject to any disclaimer, the term of this patent is extended or adjusted under 35 U.S.C. 154(b) by 1823 days.

(21) Appl. No.: 10/662,700

(22) Filed: Sep. 15, 2003

(65) Prior Publication Data

US 2005/0059341 A1 Mar. 17, 2005

(51) Int. Cl.
*G06Q 30/00* (2012.01)
*G06Q 90/00* (2006.01)

(52) U.S. Cl.
CPC ..... *G06Q 90/00* (2013.01)
USPC ..... 705/14.1

(58) Field of Classification Search
CPC ..... G06Q 90/00
USPC ..... 705/14, 14.1
See application file for complete search history.

(56) References Cited

U.S. PATENT DOCUMENTS 5,271,626 A * 12/1993 Llenas et al. ..... 273/430
6,384,744 B1 5/2002 Philyaw et al.
2001/0034654 A1 10/2001 L. Vigil et al.
2002/0004742 A1 1/2002 Willcocks et al.
2002/0049631 A1 4/2002 Williams
2002/0049967 A1 4/2002 Haseltine et al.
2002/0052780 A1 5/2002 Landesmann
2002/0053076 A1 5/2002 Landesmann
2002/0087400 A1 7/2002 Khoo et al.
2002/0120504 A1 8/2002 Gould et al.
2002/0147688 A1 * 10/2002 Arai ..... 705/52
2002/0178058 A1 11/2002 Ritchie et al.
2002/0178060 A1 11/2002 Sheehan
2003/0050834 A1 3/2003 Caplan

* cited by examiner

*Primary Examiner* — Daniel Lastra
(74) *Attorney, Agent, or Firm* — Amster, Rothstein & Ebenstein LLP

(57) ABSTRACT

A method of advertising within a radio broadcast program which features the playing of songs and broadcasting commercials, the method including the steps:

A. establishing a contest whereby listeners of the program may become participants in the contest by following procedures of the contest, the contest including the broadcast of clues from time to time following broadcast of one of the commercials, with the contest requirement that a participant respond to at least one broadcasted clue and follow the required procedure of the contest, B. broadcasting at least one set of songs during the program, C. broadcasting at least one commercial during the program, D. broadcasting at least one clue following the at least one commercial, and E. providing a specified award to each participant whose response to the clue satisfied the contest requirements to win the award.

13 Claims, 3 Drawing Sheets

FIG. 1 - Prior Art

ENHANCED METHOD OF RADIO AND TV ADVERTISING

BACKGROUND OF THE INVENTION

1. Field of the Invention

This invention is in the field of radio and television broadcasting and advertising, and more particularly in the use of games and contests within the radio or television broadcasts to encourage radio listeners and television viewers to be more attentive to the broadcasts and more attentive to the commercials.

2. Prior Art

The prior art discloses a great variety of methods for trying to enhance the effectiveness of advertising as used in television, radio and on the Internet. The types of radio broadcasts for which this present invention is particularly relevant are the popular music programs which present programs of continuous music with advertisements interspersed between songs or between sets of songs.

It is recognized that listeners are usually less interested in the advertisements than in the music and the programs, and that listeners often take steps to avoid hearing the advertisements, such as disregarding the advertisements, leaving the vicinity of the radio, "surfing" which is rapid skipping from one program to another, or simply abandoning any program lacking compelling interest.

To counteract this disinterest of listeners advertisers have developed contests and games to encourage listening to programs and to advertisements by including in the programs clues or triggering events, which when heard by listeners may lead them to take certain action for which they will receive rewards or become eligible for possible rewards. Typically, the clues or triggering events are words statements or sounds that are broadcast between songs of a set of songs or possibly broadcast while a particular song is playing. Contest rules may widely vary as regards the nature of the clues, the nature of the responsive actions required of the participants, and the nature of the reward, prize or other result obtained by winning participants. In one example, a contest may reward the caller who correctly identifies the name of a song or performer of a song being played. Other examples include a reward to the first person to call in, or to the first ten callers, or to only the $30^{th}$ caller, or to the first or to all callers within a specified time period who state a correct answer or other required response. In another contest the reward may be merely winning eligibility to participate in a secondary or further phase of the contest.

Regardless of the specific rules, protocols and rewards, all of these prior art contests insert the clues or triggering events between or among or during the songs being played, because of the basic assumption that it is the songs that draw listeners to hear the broadcast in the first place. Sometimes, the identification of the song or of the performer or of some fact related to a song is itself the clue or triggering event.

Examples of prior art patents which have addressed the general issue of enhancing the effectiveness of advertising in radio, television and/or Internet broadcasting are described below.

U.S. Patent Publication No. US 2002/0049967 A1 to Haseltine et al. concerns enhancing advertising in TV and in radio and on the Internet, namely, to provide an incentive for listeners to view the relevant broadcast. This is achieved by embedding electronic tokens into the broadcast of the programs and the commercials. The consumer has a token capture device (TCD), and the electronic tokens are radiated from the broadcast and captured by the TCD, which registers the fact that the programs and/or commercials were in fact received by the listener's receiving apparatus, such as his TV or radio. The TCD recognizes the electronic tokens and may display them or utilize other means for communicating this information to advertisers or broadcasters so that the listeners will receive their incentive rewards. While this invention induces listeners to hear commercials, it requires additional broadcast and receiving capability and still has commercials which can be ignored since they include no special triggering event appeal.

U.S. Patent Publication No. US 2002/0004742 A1 to Willcocks et al. discloses a method to enhance advertising as applied to the Internet and also via radio, TV and newspapers. In the broadcast or the other presentation media, an offer is made to the recipient, listener or observer that such person may obtain a reward if he or she acts promptly. The offer includes the condition that the value of the offer will decrease with time, and thus obviously induces the recipient to respond promptly. Alternatively, the condition could be that the response must be at a specific time.

U.S. Patent Publication No. US 2001/0034654 A1 to Vigil et al. discloses a method of interactive advertising where the viewer is offered the opportunity to win a prize in exchange for viewing an advertisement. In this invention the viewer must respond quickly, which he is supposed to do on his computer. The time period for reply may be only after a second advertisement or a second portion of an advertisement is seen, thus providing the incentive to view the entire advertisement. This invention has more elaborate aspects so that when the viewer responds with his computer via the Internet, he becomes identified in the database, which then may direct further, more personally tailored advertisements and/or rewards to him. While this provides an incentive to a viewer to watch a particular advertisement, it does not address the issue of the present invention, namely, of creating an incentive to watch all the advertisements, many of which the viewer may prefer to ignore.

U.S. Patent Publication No. US 2002/0120504 A1 to Gould et al. discloses a method including trivia contests to improve the effectiveness of advertising in broadcasts, which include TV and could include radio. The broadcast includes questions relating to advertising and other questions relating to the content of the programming. Listeners who respond are given rewards as the incentive for them to listen to the entire broadcast. This system provides benefits to the advertisers and broadcasters in that it creates a large and inexpensive research panel of television viewers who provide useful information about their reaction to the broadcast. Obviously, this system provides rewards to the listeners if they follow the rules. This invention does not include a triggering event between commercials.

U.S. Patent Publication No. US 2002/0087400 A2 to Khoo et al. discloses a method for providing a reward for viewing motion pictures and audio content from a broadcast. Here, the viewer has a television set or other broadcast receiving device which includes a component for direct interactive communication between the viewer and the broadcast source. The patent is thus directed primarily to computers with Internet connection. The viewer who communicates back to the broadcast source provides his personal identification, either automatically or by answering various questions. He then becomes part of a database which operates with a reward engine to assign and deliver rewards to the viewer who has responded. The respondent is given a reward for having viewed the broadcast; however, there is no disclosure in this patent of a broadcast of non-advertising product, such as music programs with interspersed advertisements and reward-triggering events between the advertisements, as in the present invention.

U.S. Patent Publication No. US 2002/0178060 A1 to Sheehan discloses a system for providing and redeeming electronic paperless coupons as an incentive in advertising as seen in TV, Internet and other broadcasts. For example, electronic coupons may be embedded in a video or audio program received by the consumer, or the coupon can be transmitted by a separate signal. Electronic coupons are rewarded to viewers who listen to or watch broadcasted programs. These coupons are provided in a variety of ways which can include being sent automatically to the viewer or to a retail establishment or to a smart card.

U.S. Patent Publication No. US 2002/0053076 A2 to Landesmann concerns marketing primarily on the Internet, and more particularly to the field of buyer-driven targeting of purchasing entities to thus enhance the effectiveness of advertising. In a first embodiment of this invention, the purchaser of goods over the Internet provides proof of the purchase via required steps and then receives a reward which was his or her incentive to make the purchase. By this system, advertisers may reward buyers for reading and responding to advertisements, and offer exclusive promotions, and offer promotions tailored to specific purchases or specific customers, etc.; however, this concerns neither radio broadcast of programs of songs with contest clues interspersed among songs.

SUMMARY OF THE NEW INVENTION

The prior art patents discussed above focus generally on the program content as they address the general object of motivating listeners and viewers to pay closer attention to the broadcasts and hopefully to be more affected by and responsive to the commercials. The new invention has each clue or triggering event occur, not in the body of the program between songs or after a set of songs, but following or between commercials or within a commercial, or the commercial itself is the triggering event, thus tying the triggering event to the commercials to induce listeners to pay closer attention to the commercials. This invention is applicable as well to television and other broadcast media including the Internet.

The new invention is novel and non-obvious because, in contrast to the current practice of placing a triggering event among songs in a radio broadcast, the new invention positions the triggering event (the broadcast the listeners most want to hear) among the advertisements (the broadcast the listeners least want to hear).

A first object of this invention is thus to enhance the effectiveness of certain commercials included in radio programs which broadcast songs or sets of songs. A further object is to enhance the effectiveness of said commercials by conducting a contest or game in conjunction with and during the radio broadcast, where the contest induces listeners to be more attentive to the commercials than they might otherwise be. A still further object is to broadcast to the listeners clues to which they must respond to win awards or to qualify to participate in a further phase of the contest.

Another object is to position the clues to follow commercials or to be between commercials, so that listeners interested in the contest will be induced or forced to listen to the commercials to be sure they do not miss the clues.

In one preferred embodiment of the new invention a clue is positioned for broadcast between two consecutive commercials; in another embodiment a clue is positioned to immediately follow a set of consecutive commercials; in a further embodiment a clue is "buried" within a commercial; and in a still further embodiment a clue is broadcast during the commercial. Any or all of these embodiments maybe combined in whatever way suits the advertiser or the broadcast manager.

As noted above, this invention was developed primarily for radio broadcasts of programs of music from selected CDs, tapes or records, where songs are usually played in sets of three, or four or more followed by a set of commercials, with optional narrative interspersed among the songs and commercials. The songs vary in length, commonly about three to four minutes, and the commercials vary in length, commonly thirty to sixty seconds. The contests and rewards, as described in the prior art, are as varied as the creators thereof can make them. This invention is equally applicable to broadcasts on radio or television of programs whose content is primarily news, education, sports or other entertainment.

BRIEF DESCRIPTION OF THE DRAWINGS

The above and related objects, features and advantages of the present invention will be fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
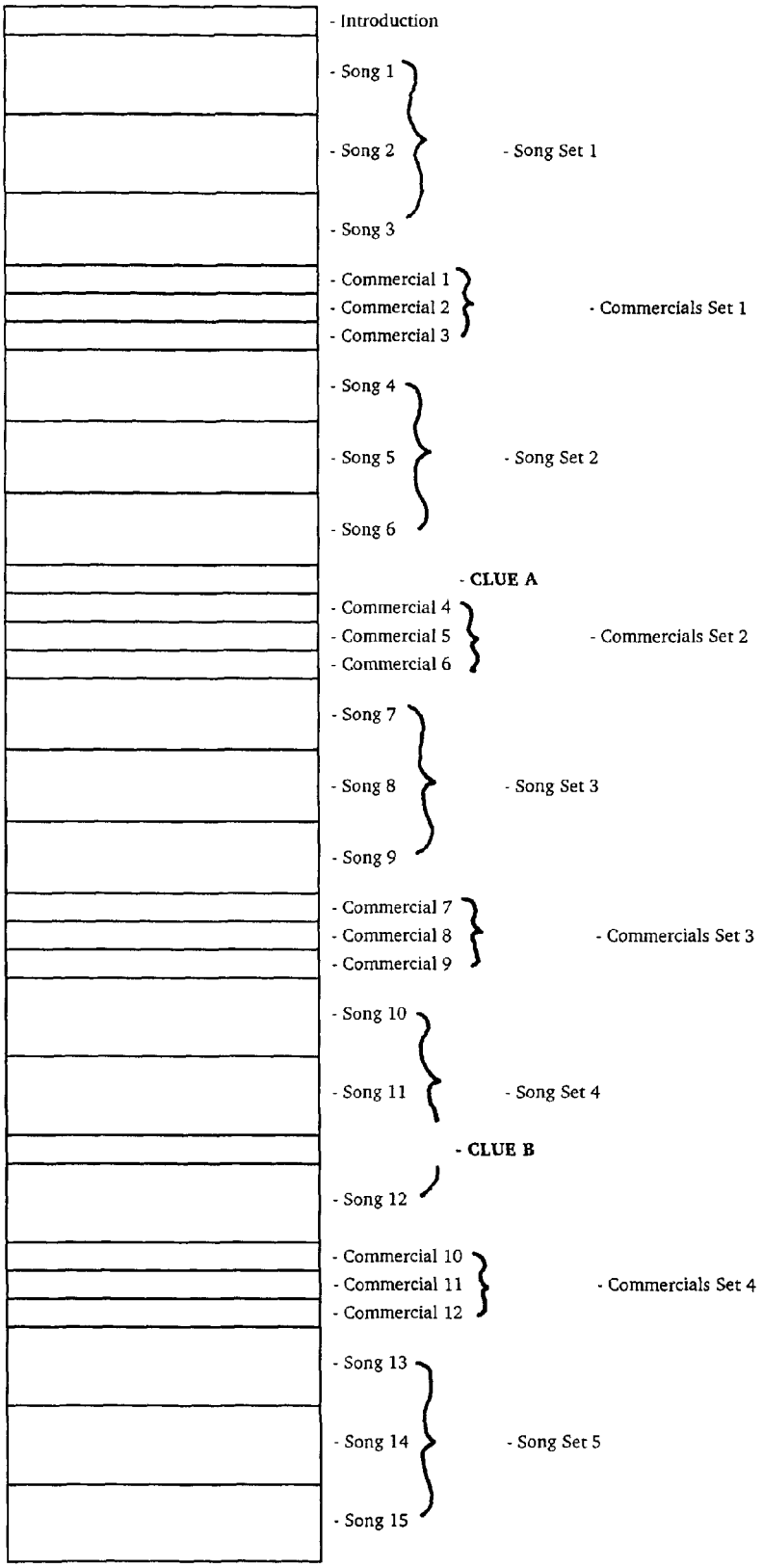
FIG. 1 is a block diagram showing schematically a prior art broadcast of a program of songs and included commercials.

FIG. 1 shows schematically a prior art broadcast of a program of songs. This figure in block diagram form represents a time line beginning at the top where there is the announcer's introduction which would include some instructions about the contest or game incorporated into this broadcast, with specific reference to the clues or triggering events, that will be included with or interspersed among or related to the songs to be played. The program begins with songs of Set 1 which are played for about ten minutes, depending on the selections. Next is a first set of commercials, designated "Commercial 1" "Commercial 2" and "Commercial 3" which are broadcast for about two minutes, depending on the design of the commercials and the ability of sponsors to afford the advertising time.

Next are songs of Set 2 generally similar in time duration to songs of Set 1, followed immediately by broadcast of a clue or triggering event designated Clue A. Next is a second set of commercials, then songs of Set 3, then a third set of commercials, then a fourth set of songs with Clue B broadcast between two songs of this set. As described earlier, many variations are possible within the general framework of songs being the focus and clues being interspersed with or related to the songs.

Figure 2:
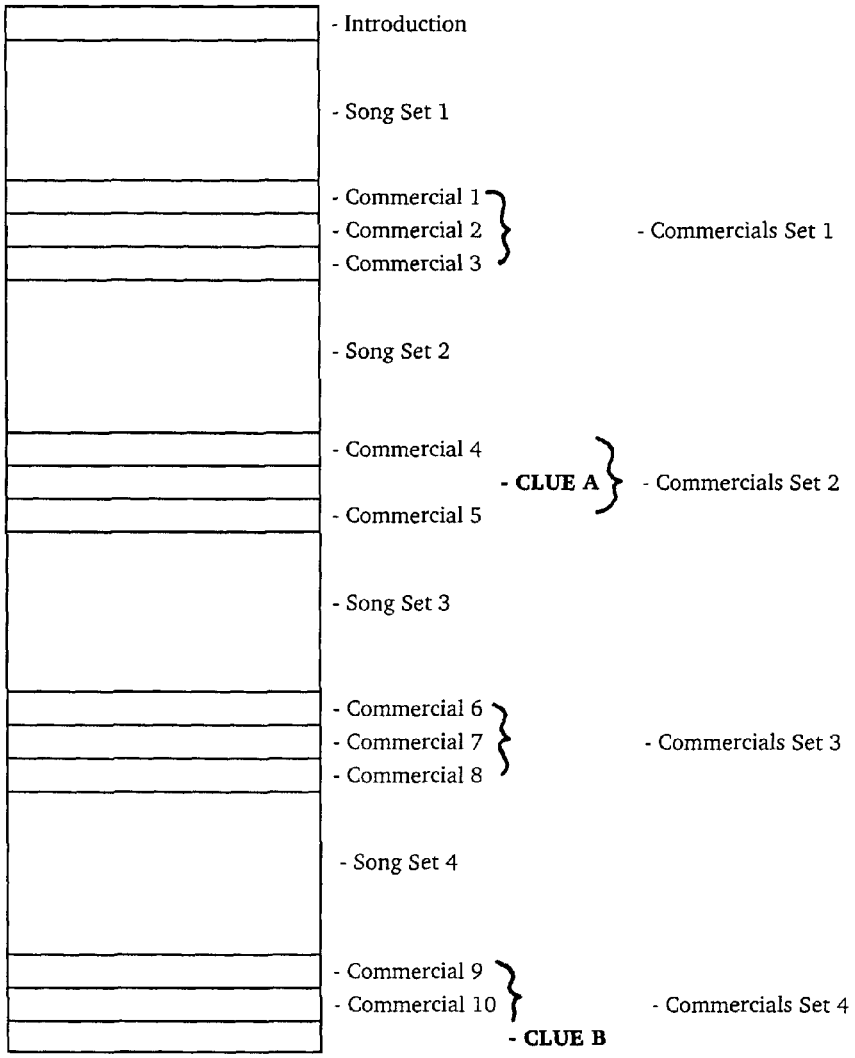
FIG. 2 is a block diagram showing schematically a first embodiment of the new invention of a broadcast of a program of songs and included commercials.

A first preferred embodiment of the new invention is shown schematically in FIG. 2 as a time line diagram generally similar to that of FIG. 1. The program begins with the introduction including comments by the announcer of the game or contest incorporated into the broadcast, and particular explanation about the clues or triggering events being among or following or in some way associated with the commercials.

Next are songs of Set 1 for about ten minutes. Next is a set of Commercials 1-3 for about two minutes, followed by songs of Set 2 . Next is a second set of Commercials 4-5 with Clue A positioned in between Commercials 4 and 5. Next are the songs of Set 3, then a third set of Commercials 6-8, then songs of Set 4, and finally another set of Commercials 9-10 with Clue B broadcast immediately following Commercial 10.

Usually, the listeners will not know in advance exactly how many commercials are in a set of commercials or will not know after which commercial the clue will appear. Thus, those interested in the contest will be motivated to listen to all the commercials to avoid missing the clues.

Figure 3:
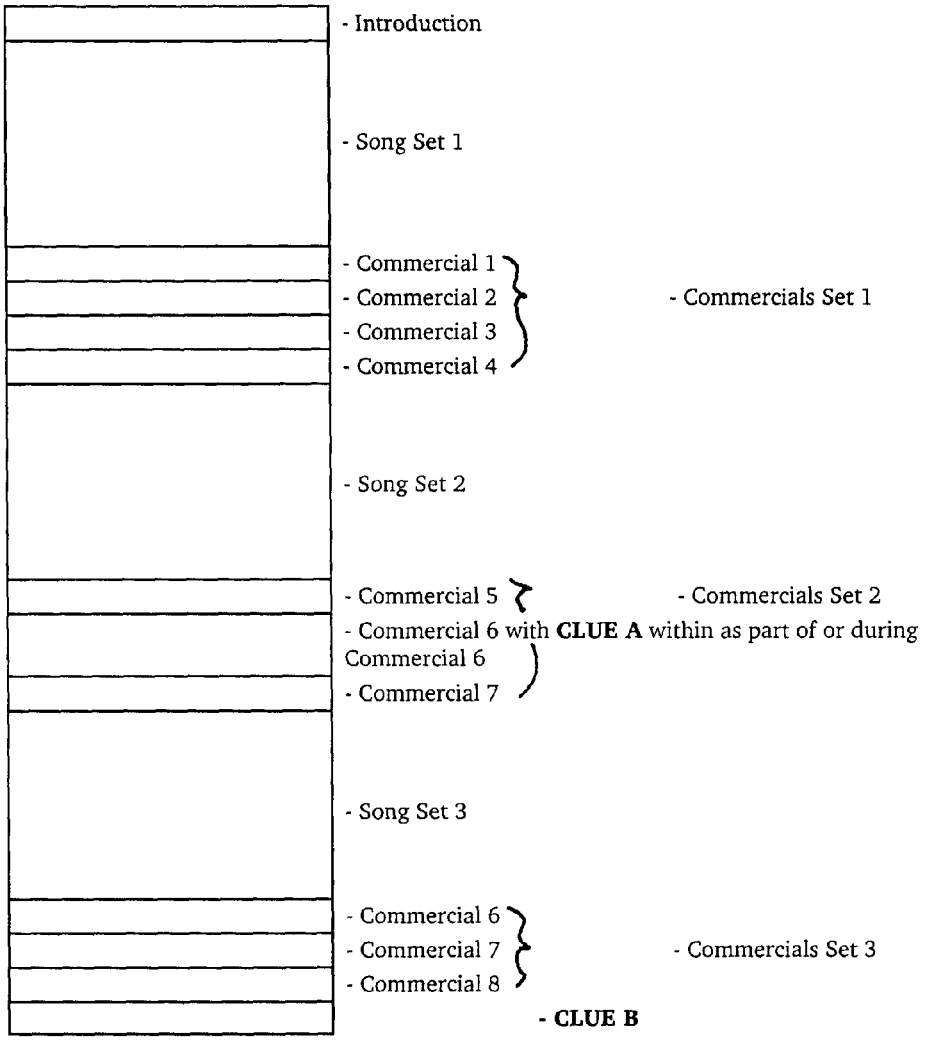
FIG. 3 is a block diagram showing schematically a second embodiment of the new invention of a broadcast of a program of songs and included commercials.

A second preferred embodiment of the new invention is shown schematically in FIG. 3 as a time line diagram generally similar to that of FIG. 2. The program in FIG. 3 begins with the announcer's introduction and continues similarly to the program of FIG. 2, except that in the second set of commercials Clue A is broadcast either within and thus as part of the commercial or during or after the commercial.

In a further embodiment the triggering event is the broadcast of a specific commercial itself, or for example, is the second or third broadcast of a specific commercial within a specified program or within a specified time period.

As indicated above, this invention offers benefits to a plurality of entities, namely (a) the broadcast company to attract more listeners, (b) the advertisers whose commercials will be listened to more attentively, and (c) the listeners who enjoy the game or contest and may win.

In still further embodiments of this invention one may vary the number of songs in the sets, the time periods of the sets of songs, the frequency, number or length of commercials, and the placement of clues among, after or within commercials. Still further variables, of course, are the rules and nature of the games or contests and the rewards.

The invention herein of positioning clues among or following commercials may be applied to radio and television broadcasts of material other than songs, such as entertainment, news, sports and other programs.

Now that the preferred embodiments of the present invention have been shown and described in detail, various modifications and improvements thereon will become readily apparent to those skilled in the art. Accordingly, the spirit and scope of the present invention is to be limited only by the appended claims, and not by the foregoing specification.

The invention claimed is:

1. A method of advertising within a radio media broadcast program which features regular program content and content related to commercials, comprising:

A. establishing a contest whereby listeners of said program may become participants in said contest by following procedures of said contest, said contest including the broadcast of clues, using radio broadcasting media, from time to time at least partially during the broadcast of the audio content of one of said commercials, the audio content related to advertisements, with the contest requirement that a participant respond to said at least one broadcasted clue and follow the required procedure of said contest, B. broadcasting, using the radio broadcast media, at least one set of regular program content during said program, C. broadcasting, using the radio broadcast media, a commercial with audio content related to an advertisement, D. broadcasting, using the radio broadcast media, at least one clue as incorporated into the audio content related to the advertisement of the commercial, broadcasting of the at least one clue beginning after broadcasting of the audio content related to the advertisement begins and ending prior to broadcasting of the audio content related to the advertisement ends, and E. providing a specified award to each participant whose response to said clue satisfied the contest requirements to win said award.

2. A method according to claim 1 comprising the step of broadcasting at least two separate sets of songs, and broadcasting at least one commercial following each of said sets of songs, and broadcasting at least one clue at least partially during at least one of said commercials.

3. A method according to claim 1 wherein said award comprises a specific prize.

4. A method according to claim 1 wherein said award comprises the right to participate in a further phase of said contest.

5. A method according to claim 1 wherein said response required of a contest participant comprises placing a call to a specified phone number.

6. A method according to claim 1 wherein said response to win the contest comprises being the nth caller of a plurality of callers, where n is a number specified in the contest procedure.

7. A method of advertising within a radio media broadcast program which features regular program content and content related to commercials, comprising:

A. establishing a contest whereby listeners of said program may become participants in said contest by following procedures of said contest, said contest including the broadcast of clues, using radio broadcast media, from time to time at least partially during the broadcast of the audio content one of said commercials, the audio content related to advertisements, with the contest requirement that a participant respond to said at least one broadcasted clue and follow the required procedure of said contest, B. broadcasting, using the radio broadcast media, at least one set of regular program content during said program, C. broadcasting, using the radio broadcast media, at least one set of commercials, at least one commercial having audio content related to an advertisement, during said program, D. broadcasting, using the radio broadcast media, at least one clue as incorporated into the audio content related to an advertisement of said at least one commercial, broadcasting of the at least one clue beginning after broadcasting of the audio content related to the advertisement begins and ending prior to broadcasting of the audio content related to the advertisement ends, and E. providing a specified award to each participant whose response to said clue satisfied the contest requirements to win said award.

8. A method according to claim 7 wherein the at least one set of regular program content comprises at least two songs, and each of said sets of commercials comprises at least two commercials.

9. A method according to claim 8 wherein a typical one of said sets of regular program content is broadcast for about ten minutes, and a typical one of said sets of commercials is broadcast for about two minutes.

10. Conducting a contest within a radio media broadcast program which features regular program content and content related to commercials, comprising:

A. establishing said contest whereby listeners of said program may become participants in said contest by following procedures of said contest, said contest including the broadcast of clues, using radio broadcast media, from time to time during broadcast of the audio content of one of said commercials, the audio content related to advertisments, with the contest requirement that a participant respond to said at least one broadcasted clue and follow the required procedure of said contest, B. broadcasting, using the radio broadcast media, at least one set of regular program content during said program, C. broadcasting, using the radio broadcast media, at least one set of commercials during said program as part of the content related to commercials, at least one commercial having audio content related to an advertisement, D. broadcasting, using the radio broadcast media, at least one clue as incorporated into the audio content related to the advertisement of the at least one commercial of said at least one set of commercials, broadcasting of the at least one clue beginning after broadcasting of the audio content related to the advertisement begins and ending prior to broadcasting of the audio content related to the advertisement ends, and E. providing a specified award to each participant whose response to said clue satisfied the contest requirements to win said award.

11. A method of advertising within a radio media broadcast which features the broadcast of regular program content for a first specified period of time and broadcasting content related to commercials during a second specified period of time, comprising:

A. establishing a contest whereby listeners or viewers of said program may become participants in said contest by following procedures of said contest, said contest including the broadcast of at least one clue, using radio broadcast media, from time to time during broadcast of the audio content of at least one of said commercials, the audio content related to advertisments, with the contest requirement that a participant respond to said at least one broadcasted clue and follow the required procedure of said contest, B. broadcasting, using the radio broadcast media, said program during the first specified period of time, C. broadcasting, using the radio broadcast media, at least one set of commercials during said second specified period of time, at least one commercial having audio content related to an advertisement, D. broadcasting, using the radio broadcast media, said at least one clue as incorporated into the audio content related to the advertisement of the at least one commercial during said second specified period of time, broadcasting of the at least one clue beginning after broadcasting of the audio content related to the advertisement begins and ending prior to broadcasting of the audio content related to the advertisement ends, and E. providing a specified award to each participant whose response to said clue satisfied the contest requirements to win said award.

12. A method of advertising within a radio media broadcast program which features regular program content and content related to commercials, comprising:

A. establishing a contest whereby listeners of said program may become participants in said contest by following procedures of said contest, said contest including the broadcast, using radio broadcast media, of triggering events from time to time, with the contest requirement that a participant respond to said at least one broadcasted triggering event and follow the required procedure of said contest, B. establishing as one rule of said contest that said triggering event will be the broadcast of audio content of a particular commercial as part of the audio content related to the commercial's audio content, C. broadcasting, using the radio broadcast media, at least one set of regular program content during said program, D. broadcasting, using the radio broadcast media, audio content of at least one of said particular commercials during said program as part of the audio content related to the commercial's audio content, and E. providing a specified award to each participant whose response to said triggering event satisfied the contest requirements to win said award.

13. A method of advertising within a radio media broadcast which features the broadcast of regular program content for a first specified period of time and broadcasting content related to commercials during a second specified time period, comprising:

A. establishing a contest whereby listeners or viewers of said program may become participants in said contest by following procedures of said contest, said contest including the broadcast of at least one triggering event, using radio broadcast media, from time to time, with the contest requirement that a participant respond to said at least one broadcasted triggering event and follow the required procedure of said contest, B. establishing as one rule of said contest that said triggering event will be the broadcast audio content of a particular commercial as part of the audio content related to the commercial's audio content during the second specified time period, C. broadcasting, using the radio broadcast media, said regular program content for the first specified period of time, D. broadcasting, using the radio broadcast media, said at least one of said particular commercials which is said triggering event during the second specified time period, and E. providing a specified award to each participant whose response to said triggering event satisfied the contest requirements to win said award.

* * * * *